US007377203B2

(12) United States Patent
Chomik

(10) Patent No.: US 7,377,203 B2
(45) Date of Patent: May 27, 2008

(54) STORAGE DEVICE LID

(75) Inventor: Richard S Chomik, Middlesex, NJ (US)

(73) Assignee: Playtex Products, Inc., Westport, CT (US)

( * ) Notice: Subject to any disclaimer, the term of this patent is extended or adjusted under 35 U.S.C. 154(b) by 978 days.

(21) Appl. No.: 10/195,302

(22) Filed: Jul. 15, 2002

(65) Prior Publication Data

US 2003/0029290 A1 Feb. 13, 2003

Related U.S. Application Data

(60) Provisional application No. 60/307,191, filed on Jul. 23, 2001, provisional application No. 60/305,653, filed on Jul. 16, 2001.

(51) Int. Cl.
*B26D 1/25* (2006.01)

(52) U.S. Cl. ..... 83/582; 83/648; 83/946; 53/567; 53/576

(58) Field of Classification Search ..... 83/649, 83/946, 648, 614, 488, 489, 582, 563; 725/43, 725/71, 89; D32/53; D7/392; D9/437; D34/11; 138/118.1; 206/303, 802, 69; 220/904, 220/908, 277, 908.1, 495.06, 495.07, 258.4, 220/267; 4/452; 53/459, 370, 567, 390, 53/576, 544, 549, 577, 574, 483; 222/80–91
See application file for complete search history.

(56) References Cited

U.S. PATENT DOCUMENTS 1,572,304 A * 2/1926 Morton ..... 83/455
2,682,267 A * 6/1954 Testa ..... 83/648
2,823,969 A * 2/1958 Traver et al. ..... 83/454
3,142,217 A * 7/1964 Busse ..... 83/375
3,142,426 A * 7/1964 Busse ..... 225/43
3,240,093 A * 3/1966 Bell, Jr. et al. ..... 83/485
3,301,117 A * 1/1967 Spaulding ..... 83/455
3,452,368 A 7/1969 Couper
4,156,382 A * 5/1979 Baker ..... 493/86
4,245,536 A * 1/1981 Urion ..... 83/821
4,417,495 A * 11/1983 Gordon et al. ..... 83/175
4,709,830 A * 12/1987 Kreiseder ..... 220/258.4
4,787,284 A * 11/1988 Chen ..... 83/614
4,869,049 A 9/1989 Richards et al. ..... 53/459
4,901,435 A * 2/1990 Tahara ..... 30/2
4,934,529 A 6/1990 Richards et al. ..... 206/303
4,987,812 A * 1/1991 Benavidez ..... 83/455
5,044,241 A * 9/1991 Labrecque ..... 83/489
5,056,293 A 10/1991 Richards et al. ..... 53/116
5,505,326 A * 4/1996 Junko ..... 220/278

(Continued)

FOREIGN PATENT DOCUMENTS

CA 1298191 3/1992

(Continued)

*Primary Examiner*—Kenneth E. Peterson
(74) *Attorney, Agent, or Firm*—Ohlandt, Greeley, Ruggiero & Perle, L.L.P.

(57) ABSTRACT

A lid for a storage device having a storage film is provided. The lid has a lid body and a cutting member having a cutting surface. The cutting member is movable between a first position in which the cutting surface is remote from the storage film and a second position in which the cutting surface is in contact with the storage film.

12 Claims, 7 Drawing Sheets

U.S. PATENT DOCUMENTS

| | | | | |
|---|---|---|---|---|
| 5,520,303 | A | 5/1996 | Bernstein et al. | 220/404 |
| 5,535,913 | A | 7/1996 | Asbach et al. | 220/404 |
| 5,590,512 | A | 1/1997 | Richards et al. | 53/567 |
| 5,611,255 | A * | 3/1997 | Evans | 83/614 |
| 5,651,231 | A | 7/1997 | Garland | 53/258 |
| 5,655,680 | A | 8/1997 | Asbach et al. | 220/404 |
| 5,765,339 | A | 6/1998 | Garland | 53/258 |
| 5,813,200 | A | 9/1998 | Jacoby et al. | 53/567 |
| 6,128,890 | A | 10/2000 | Firth | 53/567 |
| 6,170,240 | B1 | 1/2001 | Jacoby et al. | 53/567 |
| D463,636 | S * | 9/2002 | Chomik et al. | D32/37 |
| 2003/0140760 | A1 * | 7/2003 | Bory | 83/614 |

FOREIGN PATENT DOCUMENTS

| | | |
|---|---|---|
| CA | 1318234 | 5/1993 |
| CA | 2019173 | 7/1998 |
| EP | 0 281 335 | 2/1988 |
| GB | 2 206 094 | 12/1988 |
| GB | 2 292 725 | 3/1996 |
| WO | WO 97/02768 | 1/1997 |
| WO | WO 98/17536 | 4/1998 |

* cited by examiner

STORAGE DEVICE LID

RELATED APPLICATION

This application is related to and claims priority in, now abandoned U.S. Provisional Application Ser. No. 60/305,653, filed Jul. 16, 2001 and now abandoned U.S. Provisional Application Ser. No. 60/307,191, filed Jul. 23, 2001, the disclosures of which are incorporated herein by reference.

BACKGROUND OF THE INVENTION

1. Field of the Invention

The present invention relates to a storage device or container. More particularly, the present invention relates to a waste storage device having a lid with a cutter movably fastened therein.

2. Description of the Prior Art

Storage devices such as for disposal of waste, baby diapers or other personal waste material, are known. Such waste storage devices have a main body and a lid. The main body has a waste aperture inlet arranged to receive a storage bag. The lid has a movable storage bag severing means or cutter and a formation that holds the storage bag against movement during operation of the severing means.

A cutter that is movably fastened to the lid of a waste storage device, such that the lid does not require opening to perform the cutting of the storage film, is disclosed in U.S. Pat. No. 6,128,890. The cutter disclosed has a locking mechanism. The locking mechanism has a tab that flexibly extends from the lid. The tab has a tongue projecting from its upper end that is radially biased inward towards engagement with the periphery of a cutting ring. The cutting ring has indents around its periphery arranged to engage the tongue to prevent rotation of the cutting ring. When manual pressure is applied to the tab, the tongue disengages the indents and the cutting ring is free to rotate until engaging the next indent.

This locking mechanism requires engagement of a tongue and indents to lock the cutting ring. This arrangement is prone to slippage. The disclosed cutting ring rotates about a vertical axis along the center of the waste storage device, but does not move in a vertical direction. Thus, the cutting ring is positioned in close proximity to the film so that it can cut the film when the lid is in a closed position. This structure may create a problem with inadvertent cutting of the film due to contact of the blade with the film, and may create a problem with snagging of the film by the cutter ring each time the lid is placed in a closed position. Also, the disclosed cutting ring has one blade. Therefore, it requires a 360° rotation of said cutting ring to achieve a single pass of the blade along the film. This may result in failure to fully cut the film.

SUMMARY OF THE INVENTION

It is an object of the present invention to provide a waste storage device with an improved cutter.

It is another object of the present invention to provide such a waste storage device that child-proofs the use of the cutter.

It is still another object of the present invention to provide a waste storage device with an improved cutting assembly that prevents unintentional cutting of the film.

It is yet another object of the present invention to provide a waste storage device with an improved cutting assembly that prevents snagging of the film by the cutter each time the lid is placed in a closed position.

It is a further object of the present invention to provide a waste storage device with an improved cutting assembly that ensures complete cutting of the film.

The above objects and advantages of the present invention are provided by, and the present invention includes, a lid for a storage device having a storage film, whereby the lid comprises a lid body and a cutting member having a cutting surface. The lid body is secured to the storage device and the storage film is housed in the storage device. The cutting member is movably secured to the lid body and is movable between a first position wherein the cutting surface is remote from the storage film and a second position wherein the cutting surface is in contact with the storage film.

The cutting surface can rotatably move to cut the storage film. The lid body can be pivotally secured to the storage device to allow selective access to the storage film. The lid body can further comprise a locking mechanism that releasably engages the lid body with the storage device. The cutting member can be biased towards the first position. The cutting member can comprise a first portion having a handle member and a second portion having an outer surface, with the cutting surface secured to the second portion. The handle member can be integrally formed with the first portion. The second portion can have a disc-like shape. The cutting surface can be disposed along the outer circumference of the outer surface. The cutting surface can be a plurality of cutting surfaces disposed on opposite sides along the outer circumference of the outer surface.

The lid can further comprise a retaining member, wherein the cutting surface is retained in the second position by the retaining member until the cutting surface makes at least one complete cutting pass across the storage film. The storage film can be tubular.

The lid can also comprise a cutting surface that moves in at least two different directions to cut the storage film. The at least two different directions can be orthogonal to each other.

The lid can also comprise a cutting member that moves in at least one axial direction and at least one rotational direction for the cutting surface to cut the storage film. The at least one axial direction and the at least one rotational direction can be orthogonal to each other.

Other and further objects, advantages and features of the present invention will be understood by reference to the following.

DESCRIPTION OF THE INVENTION

Figure 1:
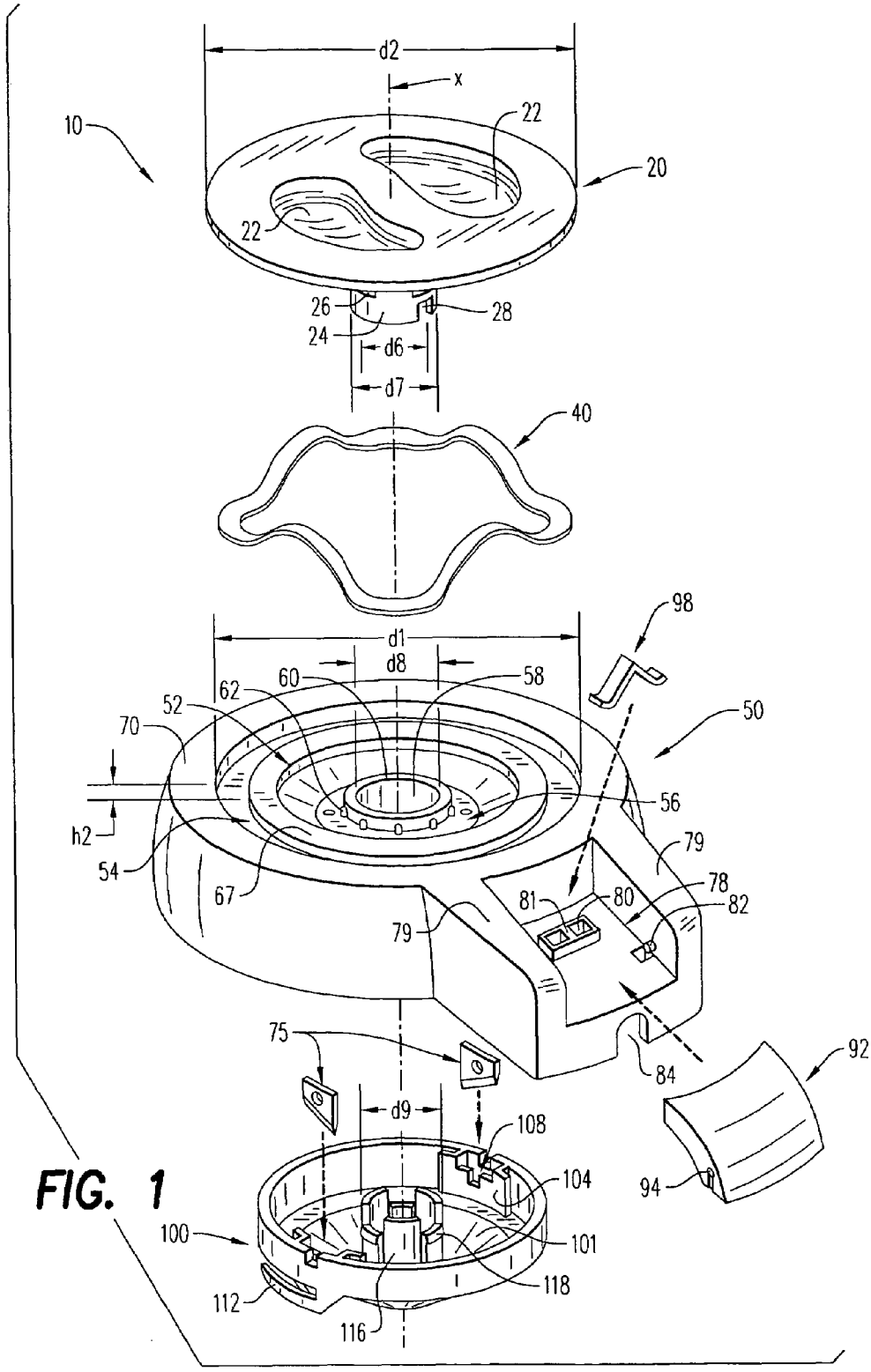
FIG. 1 is an exploded view of the lid assembly of the present invention.

Referring to the drawings and, in particular, FIG. 1, there is shown a preferred embodiment of the lid assembly for a waste storage device of the present invention generally represented by reference numeral 10. While this embodiment is for a waste storage device, the device 10 can be other types of storage devices that have a storage film.

Referring to FIG. 1, lid assembly 10 has a handle member 20, a lid member 50 having a latch assembly 90, a spring 40 to be positioned in the lid member between the handle member and the lid member, and a blade shoe member 100 adapted to receive one or more blades 75.

Figure 2:
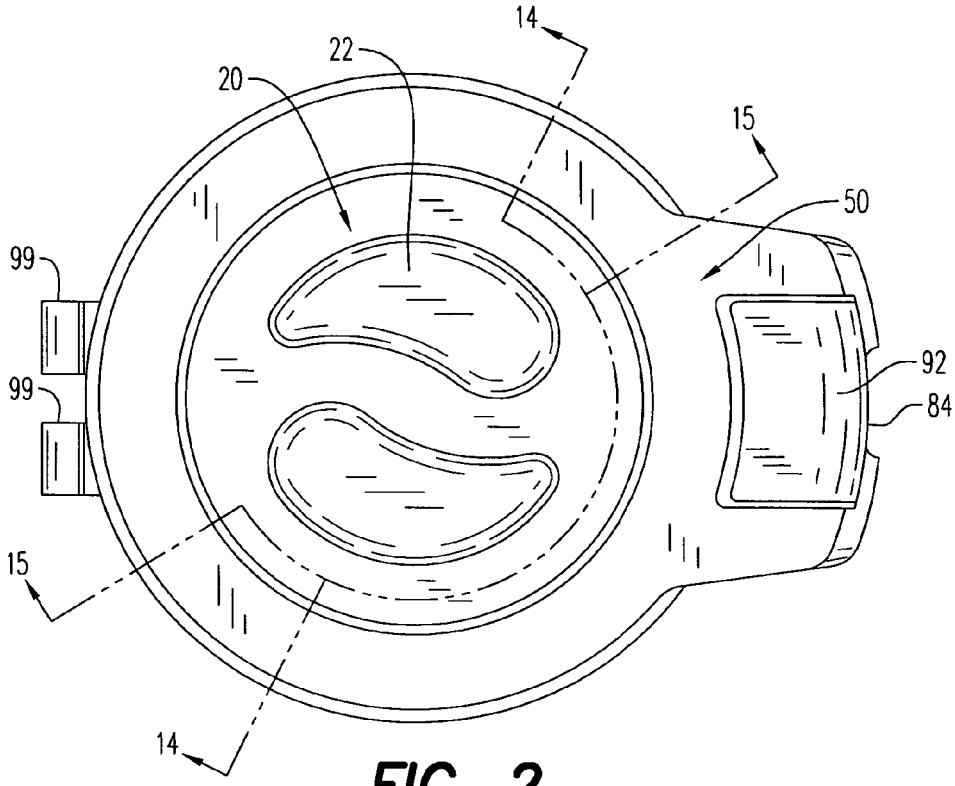
FIG. 2 is a top view of the assembled lid assembly of FIG. 1.
Figure 3:
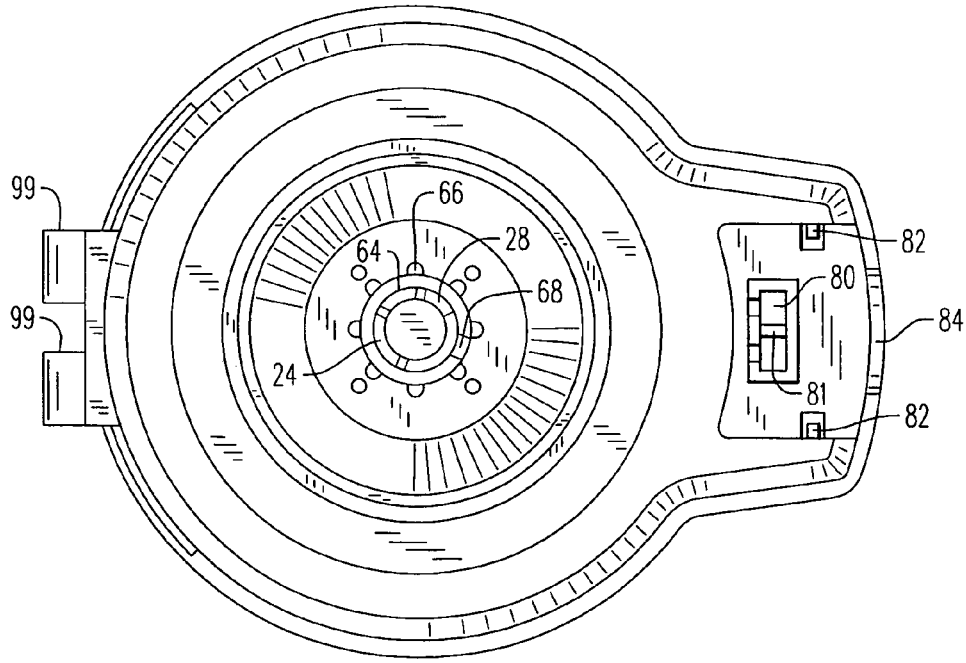
FIG. 3 is a bottom view of the lid member assembled with the handling member of the lid assembly of FIG. 1.
Figure 4:
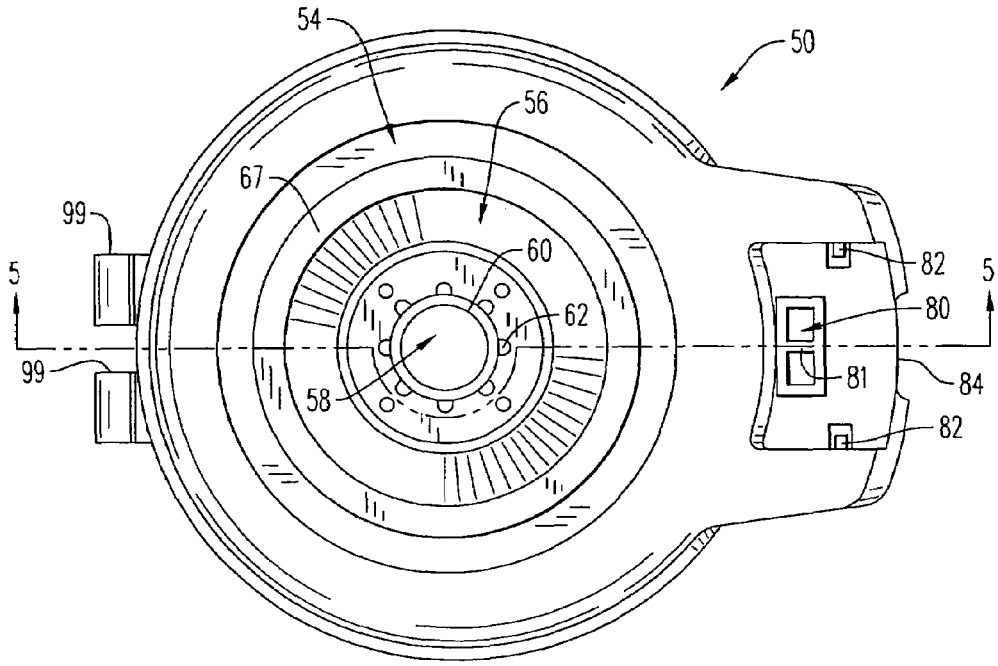
FIG. 4 is a top view of the lid member of the lid assembly of FIG. 1.
Figure 12:
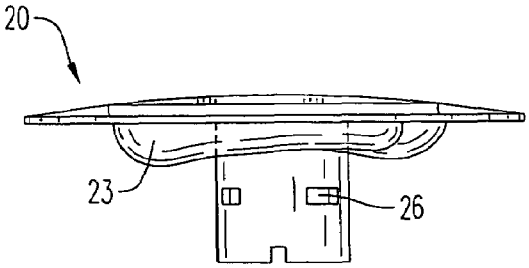
FIG. 12 is a front view of the handle member of the lid assembly of FIG. 1.
Figure 13:
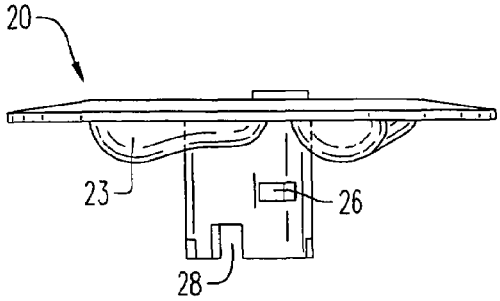
FIG. 13 is a side view of the handle member of the lid assembly of FIG. 1.
Figure 14:
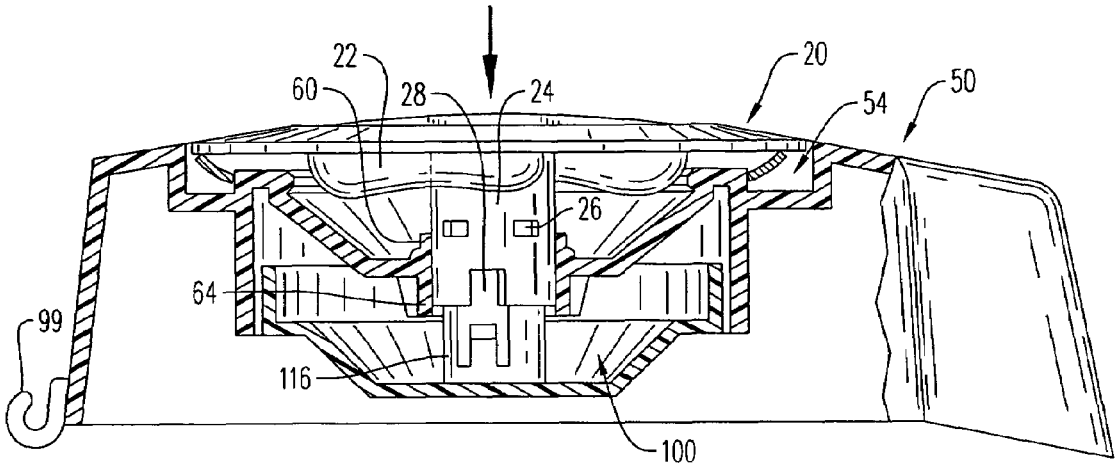
FIG. 14 is a cross-sectional view of the lid assembly of FIG. 2 taken along line 14-14, with the handle member and blade shoe member partially engaged and the handle member in its upper most position.
Figure 15:
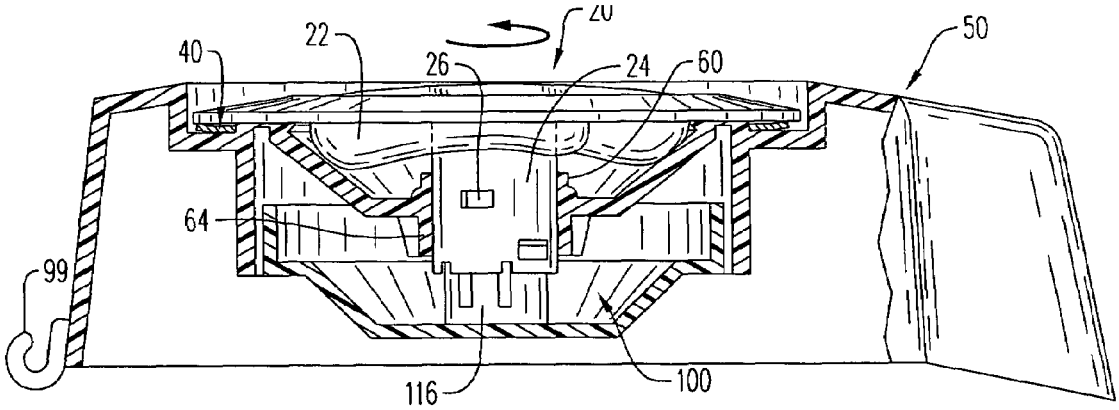
FIG. 15 is a cross-sectional view of the lid assembly of FIG. 2 taken along line 15-15 with the handle member and blade shoe member partially engaged and the handle member in its lower most position.

Referring to FIGS. 1 and 2, handle member 20 is essentially disc-like in shape. The handle member 20 has two handling grooves 22 formed therein that extend downward from a center area of an undersurface 23 (shown in FIGS. 12 and 13) of the handle member, to facilitate movement of the handle member. Referring to FIGS. 1 and 3, handle member 20 has undersurface 23 that has a lid assembly casing 24. Lid assembly casing 24 perpendicularly extends therefrom along a center axis x. Lid assembly casing 24 is cylindrical in shape and has an open end and a closed end. Lid assembly casing 24 preferably is integrally formed with handle member 20 and has an inner diameter d6 and an outer diameter d7 at its open end. Lid assembly casing 24 preferably includes three lid assembly slots 26 and a rotation locking tab notch 28.

Referring to FIG. 1, lid member 50 is substantially cylindrical in shape and has a handle member cavity 52 formed therein. The diameter d1 of handle member cavity 52 is slightly larger than the diameter d2 of handle member 20 so that the handle member can be positioned within the handle member cavity and is rotatable therein.

The handle member cavity 52 has a spring channel 54 and a handle groove channel 56 preferably formed therein. The spring channel 54 and handle groove channel 56 are each substantially circular in shape. The spring channel 54 preferably has a diameter and depth such that when wave-shaped spring 40 is compressed along axis x, it fully fits in spring channel 54.

Spring 40 is any biasing structure that exerts a force preferably onto handle member 20. However, it can also be any biasing structure that biases the cutting structure away from the film. Preferably, spring 40 is a wave-shaped spring. More preferably, wave-shaped spring 40 has a wave with preferably at least four peaks and four valleys. A preferred wave-shaped or wave spring 40 is made of a synthetic polymer. Suitable synthetic polymers include, for example, acetal copolymer, nylon or any combination thereof. Preferably, the synthetic copolymer is an acetal copolymer from the family of polyoxymethylene copolymers or a nylon of Type 6/6. Most preferably, the synthetic polymer is a polyoxymethylene copolymer sold under the trade name CELCON-M90® which is commercially available from Hoechst Celanese Corporation.

The spring channel 54 and handle groove channel 56, form therebetween a handle member contact surface 67. The contact surface 67 is substantially circular in shape. The contact surface 67 is positioned at a depth h2 beneath a top surface 70 of lid member 50. When handle member 20 is moved downward along axis x, it travels depth h2 until abutting against contact surface 67.

The handle groove channel 56 has a diameter, a depth and a shape such that the undersurface of handle groove 22 fully fits within handle groove channel 56 when handle member 20 is in both its upper most position and its lower most position along axis x.

The lid member 50 has formed about axis x, a lid assembly orifice 58 with a diameter d8. Extending from handle member cavity 52 along axis x, above and aligned with lid assembly orifice 58, is a lid member upper neck 60. The upper neck 60 has upper neck support abutments 62. Extending from the undersurface of lid member 50, below and aligned with lid assembly orifice 58, is a lid member lower neck 64 having a rotation locking slot 68 and lower neck support abutments 66.

The lid member 50 has an outer side surface from which extends a latch cavity 78. The latch cavity 78 is preferably integrally formed with lid member 50. The latch cavity 78 is substantially rectangular in shape and has two latch cavity arms 79 forming two of the side walls of latch cavity 78.

Figure 5:
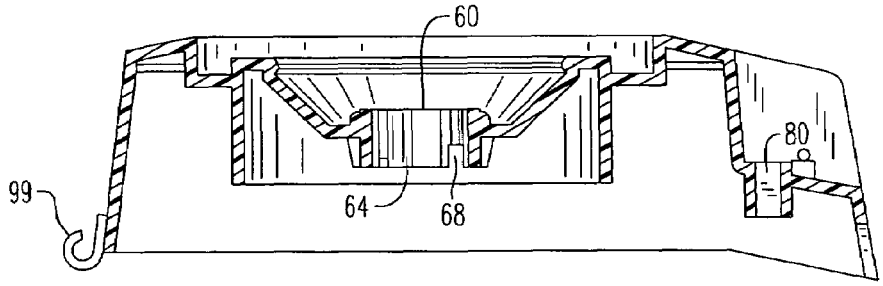
FIG. 5 is a cross sectional view of the lid member of FIG. 4 taken along line 5-5.

Referring to FIGS. 1, 3, and 5, the front surface of latch cavity 78 has a lifting notch 84 formed at the lower edge of the front surface. The bottom of latch cavity 78 has a latch hole 80, which, in the embodiment shown, is essentially rectangular in shape. The latch hole 80 has a latch hole cross member 81 that divides the latch hole into two about equal holes. The latch cavity arms 79 have an inner surface with two latch trunnions 82 extending therefrom, respectively.

Figure 7:
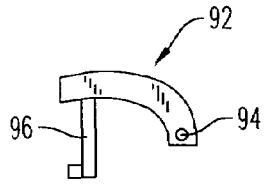
FIG. 7 is a side view of the latch button of the lid assembly of FIG. 1.
Figure 6:
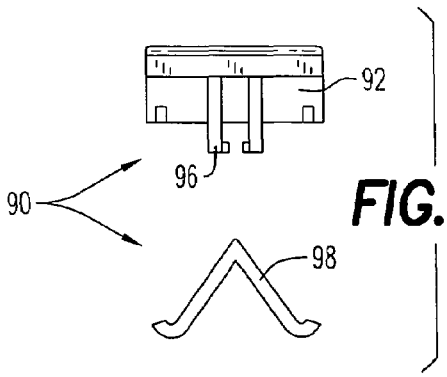
FIG. 6 is a front view of the latch assembly of the lid assembly of FIG. 1.

Referring to FIGS. 6 and 7, there is shown features of latch assembly 90. The latch assembly 90 has a latch button 92 that is preferably substantially rectangular in shape with a downward curvature. The latch button 92 has an undersurface from which extends two latch button arms 96 that are parallel to each other. Preferably, latch button arms 96 are integrally formed from the underside of latch button 92. The latch button 92 has two side surfaces, each with a latch trunnion cavity 94 formed therein. The latch trunnion cavities 94 are of a depth such that latch trunnions 82 may be positioned therein so as to create a hinge. Latch trunnion cavities 94 are positioned along the side surfaces of latch button 92 such that when engaged with latch trunnions 82, latch button arms 96 extend through each hole of latch hole 80. Latch assembly 90 also has a latch 98 that is preferably a v-shaped spring with hooks formed at the ends of each arm. The hooks are preferably v-shaped and extend outwardly. Latch 98 is positioned with its open end downward and each arm of the v-shape extending through each hole of latch hole 80. Latch button arms 96 extend over the closed end of latch 98 such that when latch button 92 is moved downward, each arm of the v-shape moves inward. The outward bias of v-shaped spring latch 98 causes latch button 92 to return to its upper most position after being depressed.

Extending from the outer side surface of lid member 50 at the bottom edge and on the opposite side from latch cavity 78, are two lid member hinges 99.

Figure 8:
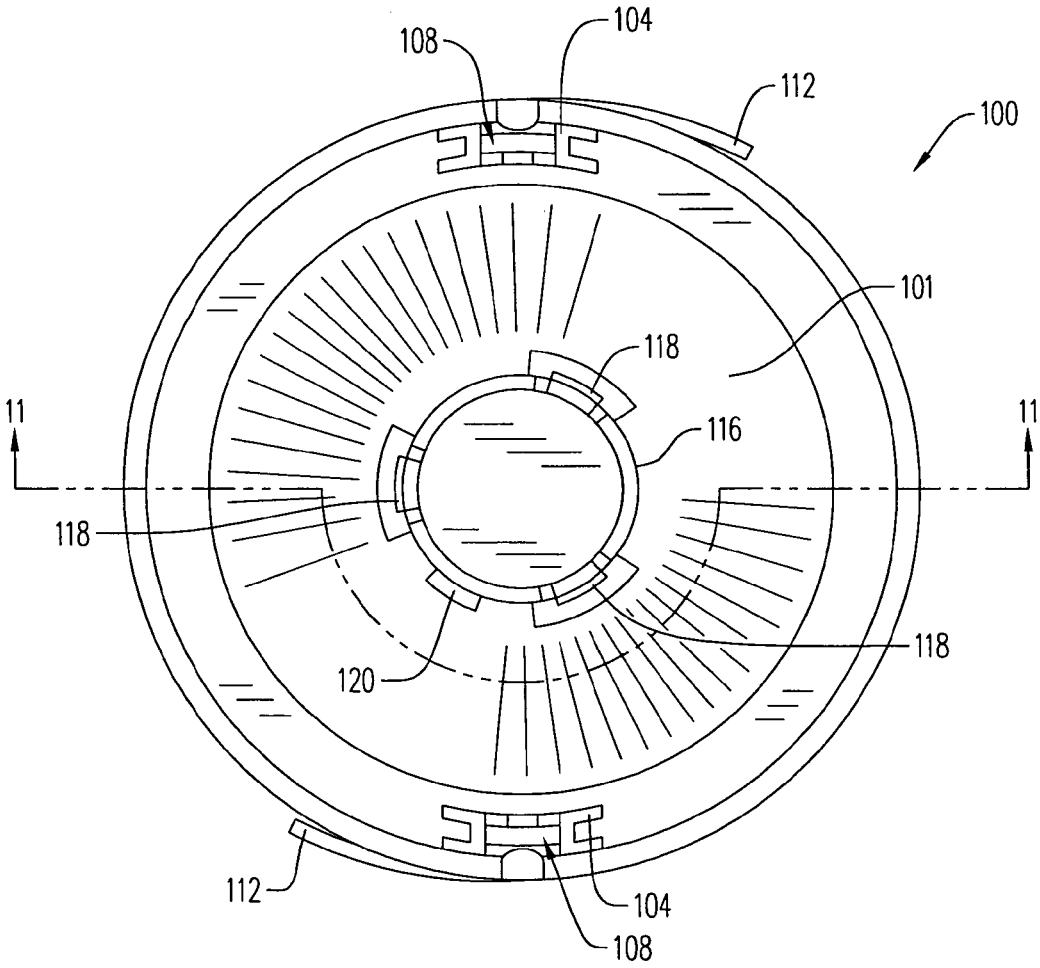
FIG. 8 is a top view of the blade shoe member of the lid assembly of FIG. 1.

Referring to FIGS. 1 and 8, blade shoe member 100 is substantially cylindrical in shape with a bottom that has a substantially downward curvature that essentially aligns with the bottom surface of lid member 50. Blade shoe member 100 has two blade holders 104 preferably integrally formed along opposite sides of the inner walls of said blade shoe member. Each blade holder 104 has a top along which is formed a blade channel 108. Blade channel 108 is of a width, depth and height such that blade 75 can be positioned in blade holder 104. Blade 75 is fastened in blade channel 108. Preferably, blade 75 is heat staked in blade channel 108. More preferably, blade 75 is heat staked in blade channel 108 by a heating iron that melts blade channel 108 about blade 75.

Figure 9:
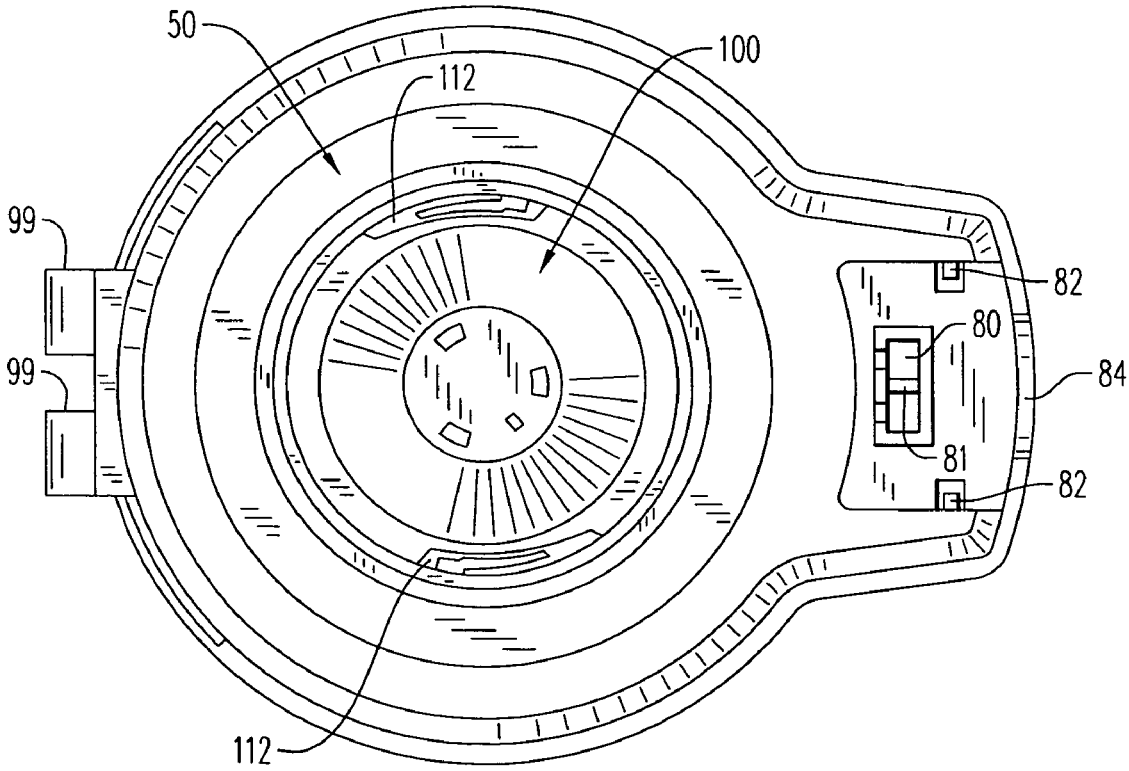
FIG. 9 is a bottom view of the assembled lid assembly of FIG. 1.
Figure 10:
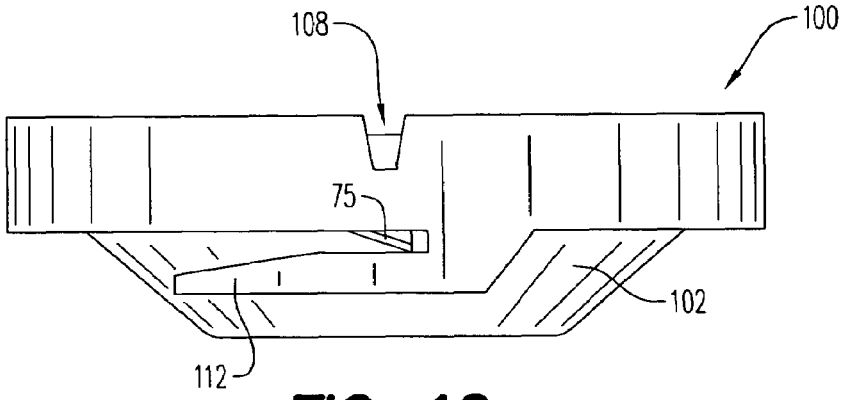
FIG. 10 is a side view of the blade shoe member of the lid assembly of FIG. 1, the opposite side being identical thereof.
Figure 11:
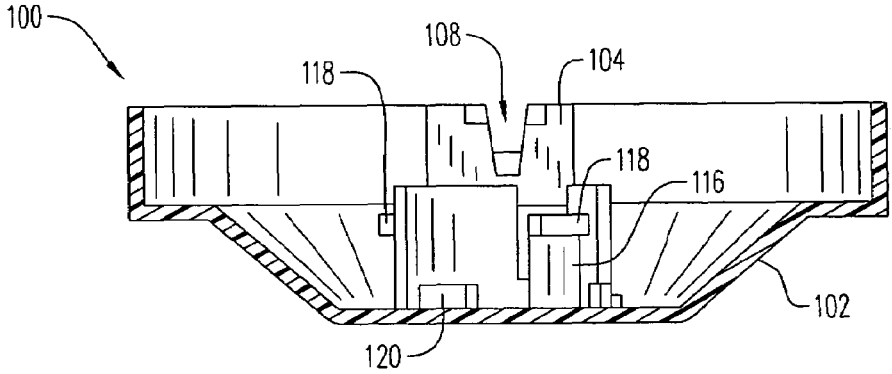
FIG. 11 is a cross sectional view of the blade shoe member of FIG. 8 taken along line 11-11.

Referring to FIGS. 9, 10 and 11, blade shoe member 100 has a bottom surface 102 from which extends two blade fingers 112. Each blade finger 112 is preferably integrally formed with blade shoe member 100. Each blade finger 112 is on an opposite side of each other. Blade finger 112 has an outer side surface with a radius of curvature greater than the radius of curvature of the outer side surface of blade shoe member 100. Accordingly, blade finger 112 extends outward beyond blade shoe member 100.

Perpendicularly extending upwards from the bottom 101 of blade shoe member 100 about axis x is a lid assembly shaft 116. Lid assembly shaft 116 is cylindrical in shape having an open end and a closed end. Lid assembly shaft 116 is molded, preferably integrally, with blade shoe member 100 and has an outer diameter d9 at its open end. As shown in FIG. 8, lid assembly shaft 116 has three equi-distantly positioned lid assembly tabs 118 extending horizontally outward from the lid assembly shaft, and a rotation locking tab 120 extending horizontally outward from the lid assembly shaft near its closed end.

Referring to FIG. 1, diameter d8 is slightly larger than diameter d7 such that lid assembly casing 24 is inserted into lid assembly orifice 58, with spring 40 in spring channel 54, and positioned between handle member 20 and lid member 50. Diameter d6 is slightly larger than diameter d9 such that lid assembly shaft 116 is inserted into lid assembly casing 24 so that lid assembly tabs 118 align with and lock into lid assembly slots 26. Thus, handle member 20, spring 40, lid member 50, and blade shoe member 100 are secured into assembly.

Referring to FIGS. 1 and 12 through 15, when blade handle member 20 is in its upper most position, rotation locking tab 120 of blade shoe member 100 passes through rotation locking tab notch 28 of handle member 20 and locks into rotation locking slot 68 of lid member 50. Lid member 50 is non-rotatably secured to the waste storage device main body. Handle member 20, and thus blade shoe member 100, are prevented from rotating about axis x due to this locking mechanism. Wave-shaped spring 40 biases handle member 20 towards its upper most position, which is its locked position.

When a downward force is placed upon handle member 20 against the bias of wave-shaped spring 40, handle member 20, and thus blade shoe member 100, move in a downward direction, distance h2 until the handle member abuts against handle member contact surface 67. This downward movement positions rotation locking tab 120 under rotation locking slot 68 and thus, allows handle member 20 and blade shoe member 100 to freely rotate about axis x. As blade shoe member 100 begins to rotate, rotation locking tab 120 extends under the bottom edge of lid member lower neck 64, preventing blade shoe member 100 and handle member 20 from returning to their upper most position. At this lower most position, blade fingers 112 and blades 75 are now in contact with the storage bag film to be cut. Once rotation locking tab 120 rotates 360° about axis x, it will be re-aligned with rotation locking slot 68 and, thus, moves in an upward direction pursuant to the upward bias of wave-shaped spring 40. This upward movement of handle member 20, and, thus, blade shoe member 100, is a snap like motion as a result of the bias of spring 40 and the distance h2 that the handle member and the blade shoe member are now forced to travel.

Blade shoe member 100 has two blades 75 secured thereto. Preferably, blades 75 are positioned 180° from each other. When blade shoe member 100 is rotated 360° about axis x, as is required due to the positioning of rotation locking tab 120 and rotation locking slot 68, the storage bag film is cut by both blades. Thus, this ensures that a complete cut of the film is made since each blade 75 makes one full cutting pass so that the film receives two cutting passes. It should be understood that the present invention could be practiced with a single blade 75 since such a single blade is rotated 360°. Moreover, the present invention could use three or more blades 75, however such a number is neither practical nor cost effective.

The present invention having been thus described with particular reference to the preferred forms thereof, it will be obvious that various changes and modifications may be made therein without departing from the spirit and scope of the present invention as defined in the appended claims.

What is claimed is:

1. A lid for a storage device having a storage film, the lid comprising:

a lid body, said lid body being secured to the storage device and movable between open and closed positions to provide selective access into the storage device, the storage film being housed in the storage device; and a cutting member having a cutting surface, said cutting member movably secured to said lid body, wherein said cutting surface moves in a first direction and a second direction to cut the storage film when said lid body is in said closed position, wherein said lid body seals the storage film in the storage device when said cutting member cuts the storage film and wherein said first direction is a downward linear motion and said second direction is rotational about an axis parallel to said first direction, said cutting member having a blade sheathed in a blade finger such that the film is not cut when the cutting member is moved in the first direction, and the film is cut when the cutting member is moved in the second direction.

2. The lid of claim 1, wherein said cutting surface is movable between a first position remote from the storage film and a second position in proximity to the storage film.

3. The lid of claim 2, wherein said cutting member is biased towards said first position.

4. The lid of claim 2, further comprising a retaining member, wherein said cutting surface is retained in said second position by said retaining member until said cutting surface makes at least one cutting pass across said storage film.

5. The lid of claim 1, wherein said lid body is pivotally secured to said storage device to allow selective access to the storage film.

6. The lid of claim 1, wherein said lid body further comprises a locking mechanism that releasably engages said lid body with said storage device.

7. The lid of claim 1, wherein said cutting member comprises a first portion having a handle member and a second portion having an outer surface, and wherein said cutting surface is secured to said second portion.

8. The lid of claim 7, wherein said handle member is integrally formed with said first portion.

9. The lid of claim 7, wherein said second portion has a disc-like shape.

10. The lid of claim 9, wherein said cutting surface is disposed along an outer circumference of said outer surface.

11. The lid of claim 10, wherein said cutting surface is a plurality of cutting surfaces disposed on opposite sides along said outer circumference of said outer surface.

12. The lid of claim 1, wherein the storage film is tubular.

* * * * *